United States Patent [19]

Mode

[11] Patent Number: 4,489,878

[45] Date of Patent: Dec. 25, 1984

[54] AUTO-DIVIDE CARTON WITH UNEQUAL CELLS

[75] Inventor: Duane Mode, Minneapolis, Minn.

[73] Assignee: Champion International Corporation, Stamford, Conn.

[21] Appl. No.: 457,870

[22] Filed: Jan. 14, 1983

[51] Int. Cl.[3] ..... B65D 5/46; B65D 5/48; B65D 5/36

[52] U.S. Cl. ..... 229/27; 206/183; 229/41 R; 229/41 B; 229/52 B

[58] Field of Search ..... 229/15, 27, 41 R, 41 B, 229/38, 37 R, 52 B, 52 BC; 206/180, 182, 183

[56] References Cited

U.S. PATENT DOCUMENTS

| | | | |
|---|---|---|---|
| 2,476,181 | 7/1949 | Crane et al. | 206/183 X |
| 2,489,034 | 11/1949 | James | 229/27 X |
| 2,712,882 | 7/1955 | Buttery et al. | 206/183 X |
| 3,118,589 | 1/1964 | Hughes | 229/27 |
| 3,184,143 | 5/1965 | Kotowick | 229/41 B X |
| 3,825,174 | 7/1974 | Booth, Jr. | 229/15 X |
| 3,912,159 | 10/1975 | Danville | 229/15 X |
| 4,219,147 | 8/1980 | Kohler | 229/41 B X |
| 4,318,470 | 3/1982 | Montealegre | 229/27 X |
| 4,345,711 | 8/1982 | Fischer | 229/52 B X |
| 4,377,252 | 3/1983 | Schillinger | 229/15 X |

FOREIGN PATENT DOCUMENTS

| | | | |
|---|---|---|---|
| 987270 | 4/1976 | Canada | 229/27 |
| 105802 | 11/1966 | Denmark | 229/15 |
| 824922 | 11/1951 | Fed. Rep. of Germany | 229/15 |
| 859905 | 1/1961 | United Kingdom | 229/41 B |
| 883150 | 11/1961 | United Kingdom | 229/27 |

*Primary Examiner*—George E. Lowrance
*Assistant Examiner*—Gary E. Elkins
*Attorney, Agent, or Firm*—Evelyn M. Sommer

[57] ABSTRACT

A carton having a plurality of unequal compartments or cells is formed from a single, unitary, paperboard blank. The carton can be folded flat for shipping and storage. It can be erected by pulling outward on two opposite corners or side edges. Internal dividers move into place automatically as the box is erected and produce internal compartments of unequal sizes.

2 Claims, 13 Drawing Figures

Fig. 5.
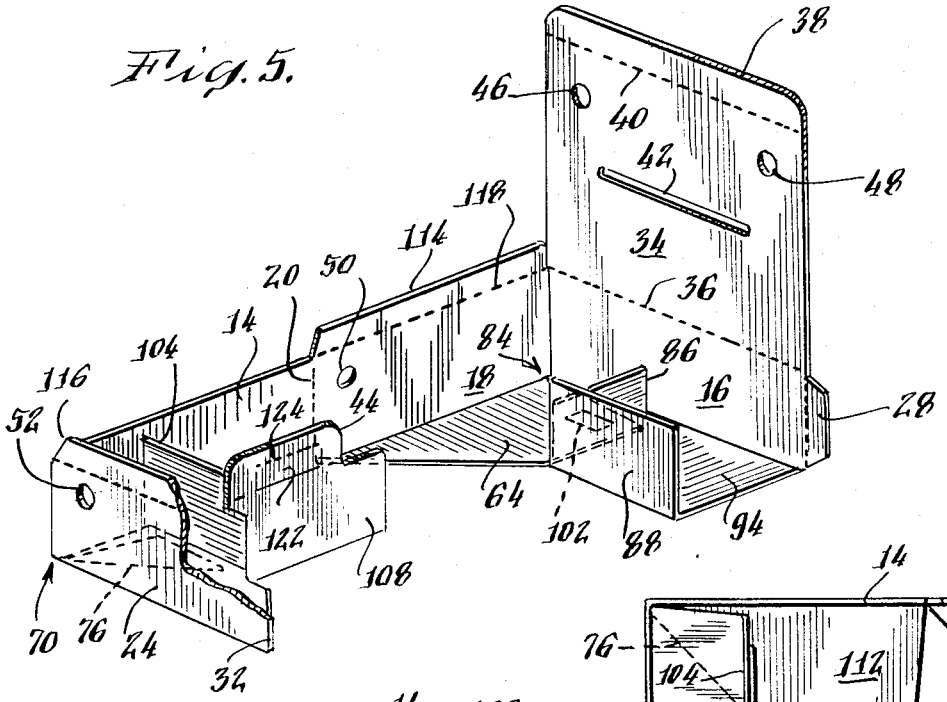
Fig. 6.
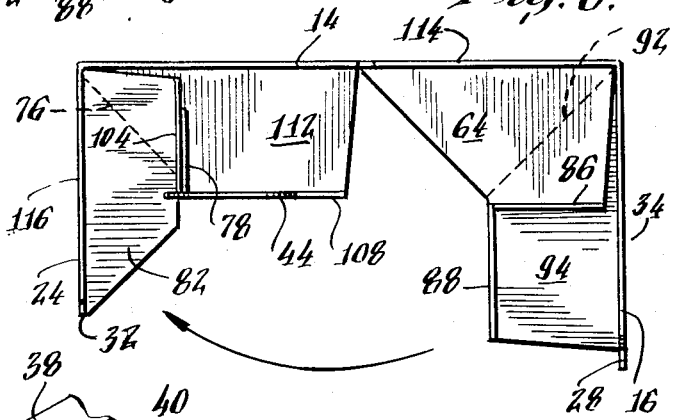
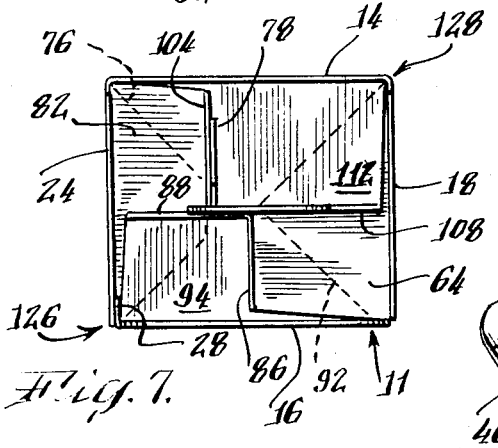
Fig. 7.
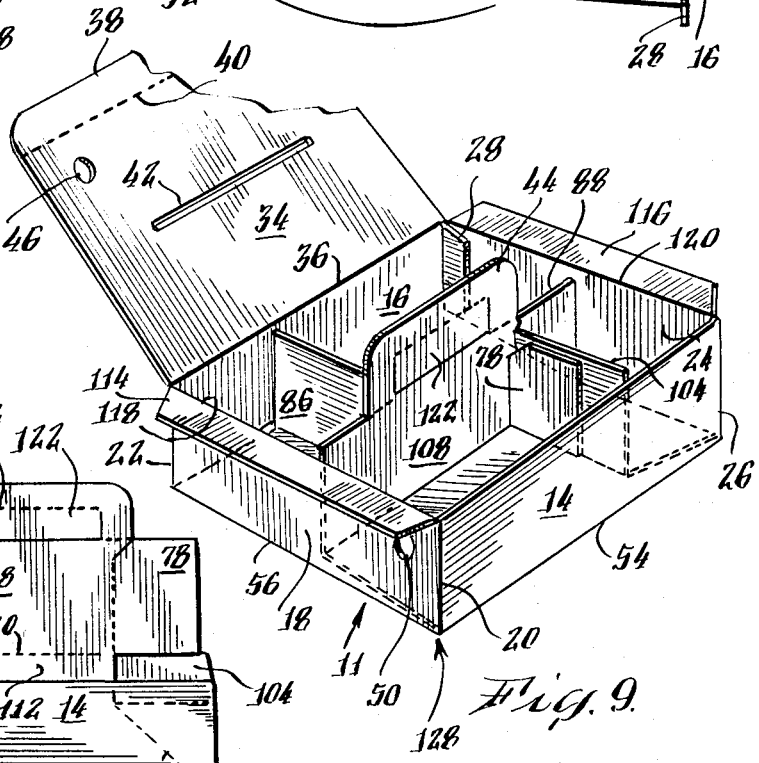
Fig. 9.
Fig. 8.
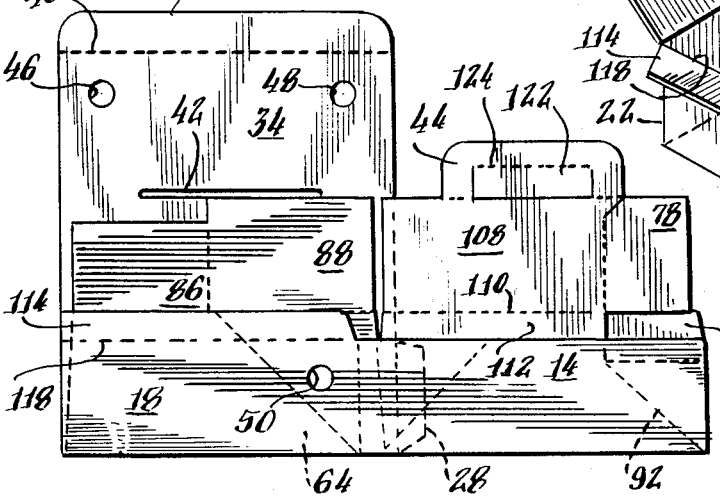

AUTO-DIVIDE CARTON WITH UNEQUAL CELLS

BACKGROUND OF THE INVENTION

1. Field of the Invention

This invention relates to a carton construction, and more particularly, to a foldable carton construction which provides a plurality of compartments or cells of unequal size in the interior of the carton. The invention also relates to a unitary blank for manufacturing the carton.

2. Description of the Prior Art

The carton of the present invention is particularly suited for use in fast food restaurants. Such restaurants serve a variety of food items including pieces of fish, chicken, and other meats, carbohydrates such as breaded onion rings and french fries, hamburgers, drinks, and the like. In the past, the containers used by such establishments have usually comprised an open-ended package, e.g., large and small bags, for receiving the food. Some packages have consisted of a tray formed from expanded polystyrene or paperboard provided with a hinged lid to maintain the food at a warm temperature when sold to the customer.

Because the various items of food sold by fast food restaurants are of different sizes, it would be desirable if a carton for such food included a plurality of internal compartments of different sizes. With such a carton, each of the various items of food making up a meal could have its own compartment or cell. This would serve to separate the various foods from each other, as well as protecting the entire meal during transit. For example, one compartment could be designed to hold the meat component of the meal, while other compartments could be used to hold such items as french fries or onion rings. Other compartments could hold condiments or eating utensils. Under some circumstances, one of the compartments might be sized to hold a drink container.

In addition to providing separation between the various food items making up a meal, a carton having individual compartments for each food item would provide a convenient way to ensure that all the components of a meal are actually supplied to each customer. This would occur because the person putting together the meal would know immediately by observing an empty compartment that an item of food had not been included in the carton. Also, because the compartments would be of unequal sizes, the person would know which item or items were missing. In the past, the various items of food making up a meal have been typically placed in one large package without individualized compartments, and thus mistakes could easily be made in determining whether or not all items of food had been included.

In addition to providing individualized compartments of different sizes, a carton for use in fast food restaurants should collapse into a small size for shipping and storage. This is so because fast food restaurants serve a high volume of food and thus require storage of a relatively large inventory of cartons.

In addition to its applications in the fast food industry, a foldable carton with a plurality of internal compartments of unequal sizes would, for the same reasons, be highly desirable in schools, hospitals and other institutional settings.

SUMMARY OF THE INVENTION

It is an object of the present invention to provide a carton for holding items of various sizes. In particular, it is an object of the invention to provide a carton which is internally divided to provide a plurality of cells or compartments of different sizes.

It is a further object of the invention to provide a carton which can be folded flat for shipping and storage.

In accordance with one aspect of the invention a carton is provided which comprises:

a front wall;

a substantially parallel rear wall;

a pair of side walls connecting said front and rear walls;

a bottom wall panel hingedly connected and extending substantially perpendicular to each of said front, rear and side walls, said bottom wall panels in combination forming the bottom of the carton; and an internal divider panel hingedly connected and extending substantially perpendicular to each of at least two of said bottom wall panels, the internal divider panels forming at least two internal compartments of unequal size.

In accordance with a further aspect of the invention, a carton is provided which comprises:

a front wall;

a substantially parallel rear wall;

a pair of side walls connecting said front and rear walls;

a bottom wall panel hingedly connected and extending substantially perpendicular to each of said front, rear and side walls, said bottom wall panels in combination forming the bottom of the carton; and two internal divider panels hingedly connected and extending substantially perpendicular to one of said bottom wall panels, the internal divider panels forming two internal compartments of unequal size.

In accordance with an additional aspect of the invention the adjacent bottom wall panels at a first set of opposed bottom corners of the carton are hingedly connected to each other and the adjacent bottom wall panels at the second set of opposed bottom corners are unattached so that the carton can be collapsed from an erect state to a folded state by inward pressure on the second set of opposed bottom corners.

In accordance with another aspect of the invention a blank for constructing a carton having a plurality of unequal internal compartments is provided which comprises:

a first panel for forming the front wall of said carton, a second panel for forming the rear wall of said carton, a third panel for forming a side wall of said carton foldably connected between parallel edges of said first and second panels, a fourth panel for forming a side wall of said carton foldably connected to an opposite edge of said first panel, a glue flap foldably connected to an opposite edge of said second panel, a bottom wall panel foldably connected to the bottom edge of each of said first, second, third and fourth panels, at most two of which bottom wall panels have equal areas, and an internal divider panel for the interior of said carton foldably connected to a bottom edge of at least two of said bottom wall panels.

In accordance with an additional aspect of the invention, a blank for constructing a carton having a plurality of unequal internal compartments is provided which comprises:

a first panel for forming the front wall of said carton, a second panel for forming the rear wall of said carton, a third panel for forming a side wall of said carton foldably connected between parallel edges of said first and second panels, a fourth panel for forming a side wall of said carton foldably connected to an opposite edge of said first panel, a first glue flap foldably connected to an opposite edge of said second panel, a bottom wall panel foldably connected to the bottom edge of each of said first, second, third and fourth panels, a first internal divider panel for the interior of said carton foldably connected to the bottom edge of one of said bottom wall panels, a second glue flap foldably connected to a side edge of said one of said bottom wall panels, and a second internal divider panel foldably connected to a side edge of said first internal divider panel and to a bottom edge of said second glue flap.

BRIEF DESCRIPTION OF THE DRAWINGS

Further objects and advantages of the present invention will become apparent from the following description and claims, and from the accompanying drawings, wherein:

FIGS. 5 and 6 are a perspective and a plan view, respectively, illustrating further steps of folding the blank of FIG. 1 to form the carton of the present invention;

FIG. 7 is a plan view of the body portion of the completed carton of the present invention;

FIG. 8 is a plan view showing the carton of the present invention in its collapsed, flat state used for shipping and storage;

FIGS. 9, 10 and 11 are perspective views of the erected carton of the present invention;

DETAILED DESCRIPTION OF THE PREFERRED EMBODIMENT

Figure 1:
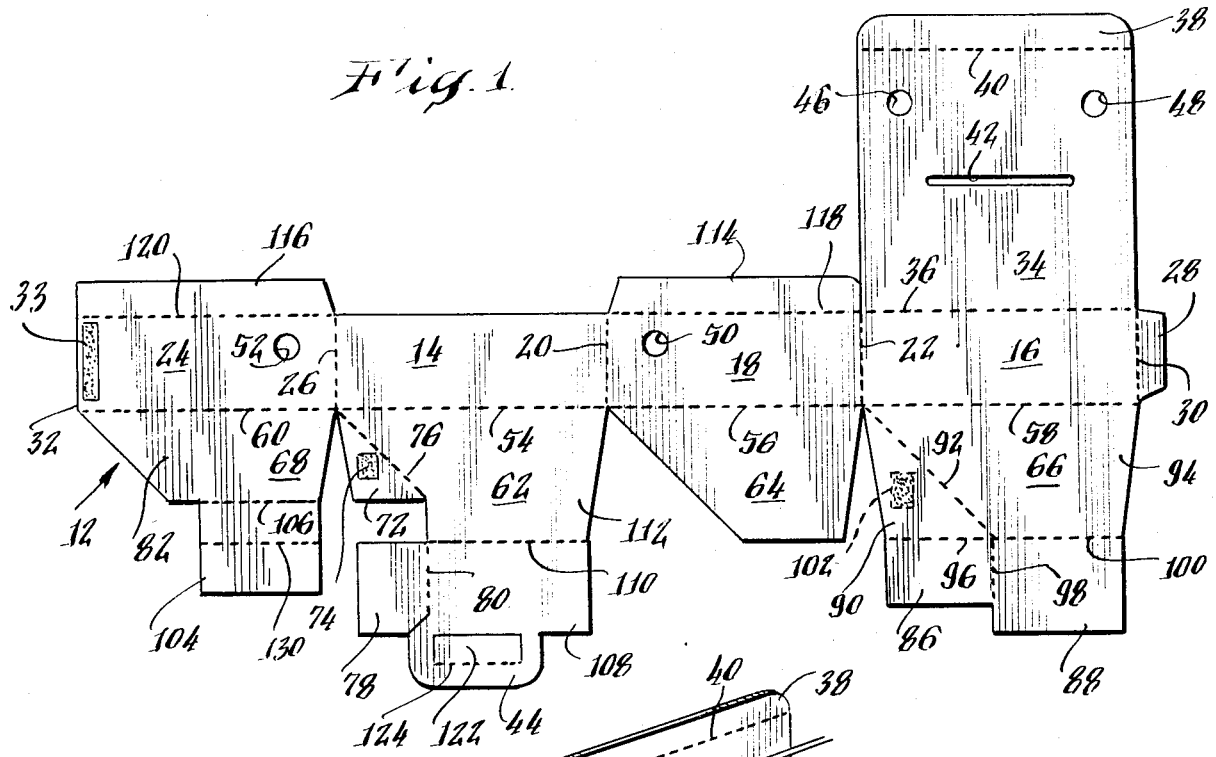
FIG. 1 is a top plan view of a blank for forming the carton of the present invention.

Referring now to the drawings in detail, wherein like numerals indicate like elements throughout the several views, a carton 10 having compartments of unequal sizes can be constructed from a unitary, one-piece paperboard blank 12 illustrated in FIG. 1.

The blank 12 includes front and rear panels 14 and 16, respectively, foldably connected by side panel 18 along opposed edges 20 and 22 thereof. A second side panel 24 is connected to the opposite side edge 26 of front panel 14. A glue flap 28 is foldably connected to free edge 30 of the rear panel 16. As described below, glue flap 28 is tucked behind free edge 32 of side panel 24 and glued to that panel along glue line 33 to form the body portion 11 of carton 10.

A cover element 34 is hingedly connected to the top edge 36 of rear panel 16. Cover element 34 includes flap 38 connected by a fold line 40 to cover element 34, which flap can be tucked into body portion 11 of carton 10 to close the container. Cover element 34 also includes aperture 42 for receiving carrying handle element 44 and vent holes 46 and 48. Side panels 18 and 24 include additional vent holes 50 and 52, respectively.

Foldably connected to the bottom edges 54, 56, 58 and 60 of panels 14, 18, 16 and 24, respectively, are panels 62, 64, 66 and 68. Panel 62 includes bottom wall panel 112, internal divider panels 78 and 108, glue flap 72 and carrying handle element 44; panel 66 includes bottom wall panel 94, internal divider panels 86 and 88, and glue flap 90; panel 68 includes bottom wall 82 and internal divider panel 104 which includes optional fold line 130; panel 64 itself constitutes a bottom wall panel. As the carton is assembled and erected, as will now be described, panels 64, 82, 94 and 112, in combination, form the bottom of the carton, and panels 78, 86, 88, 104 and 108 form the internal compartments of unequal sizes. For purposes of illustration, in the description which follows a specific sequence of assembly steps is considered. It is to be understood that other assembly sequences can be used.

FIGS. 1–4 illustrate the formation of corner 70 at the junction of front panel 14, side panel 24 and the bottom of the carton. Formation of this corner involves the movement of panel 68 relative to panel 24, the movement of panel 24 relative to panel 14, and the movement of panel 62 relative to panel 14. Although other sequences can be used to form corner 70, for purposes of illustration we will consider first the movements of panels 24 and 68 and then the movement of panels 14 and 62.

Figure 2:
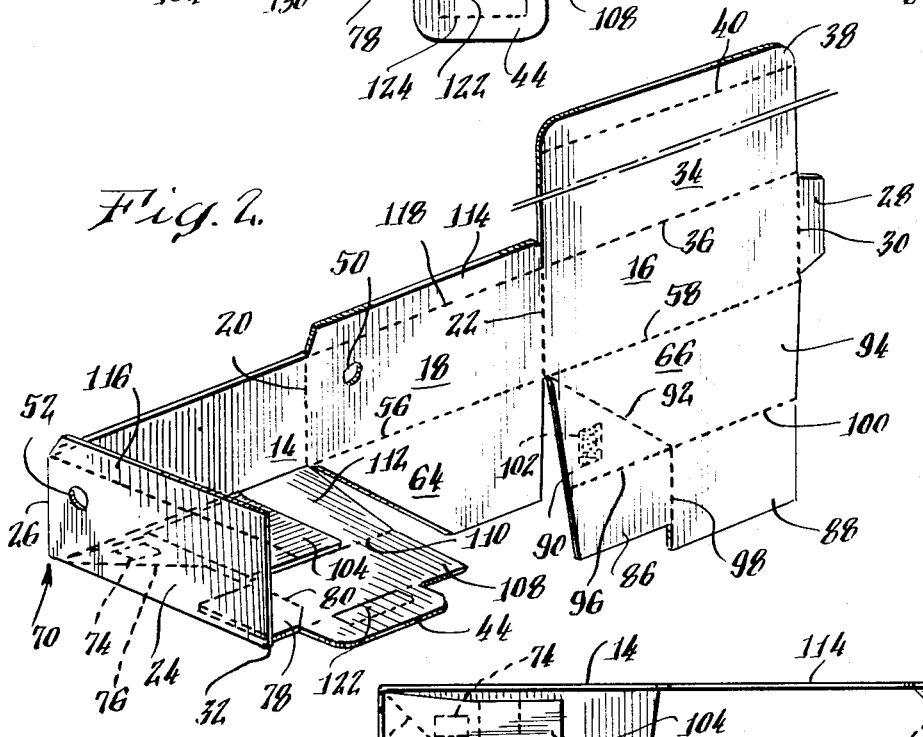
FIG. 2 is a perspective view illustrating the first steps of folding the blank of FIG. 1 to form the carton of the present invention.
Figure 3:
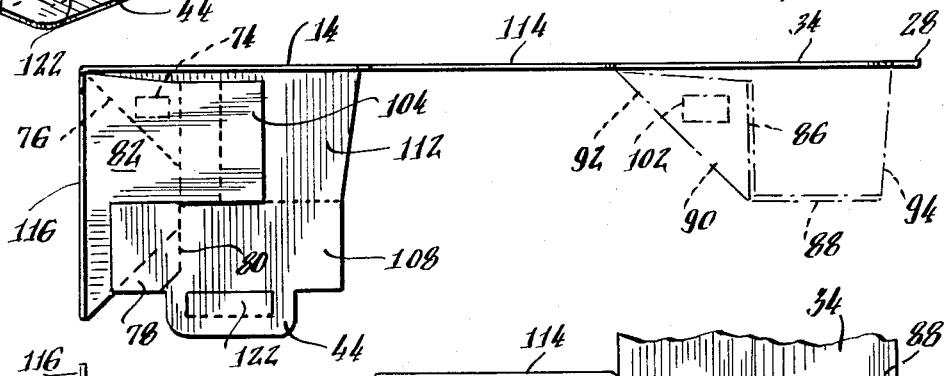
FIGS. 3 and 4 are a plan and a side view, respectively, illustrating subsequent steps of folding the blank of FIG. 1 to form the carton of the present invention.
Figure 4:
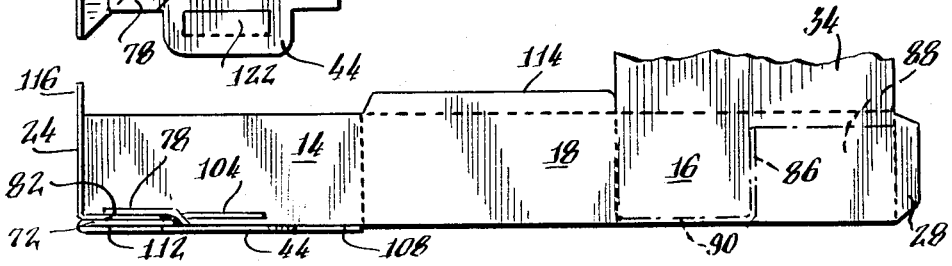
Figure 10:
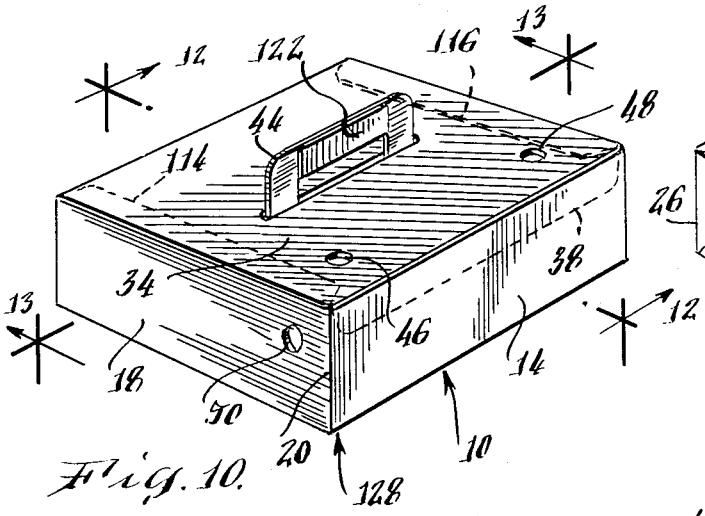
Figure 11:
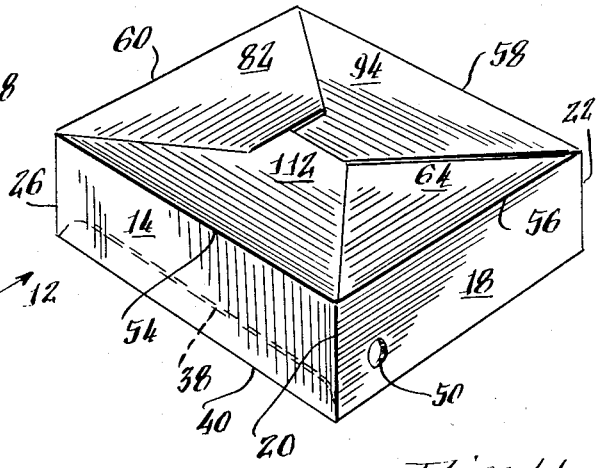
Figure 12:
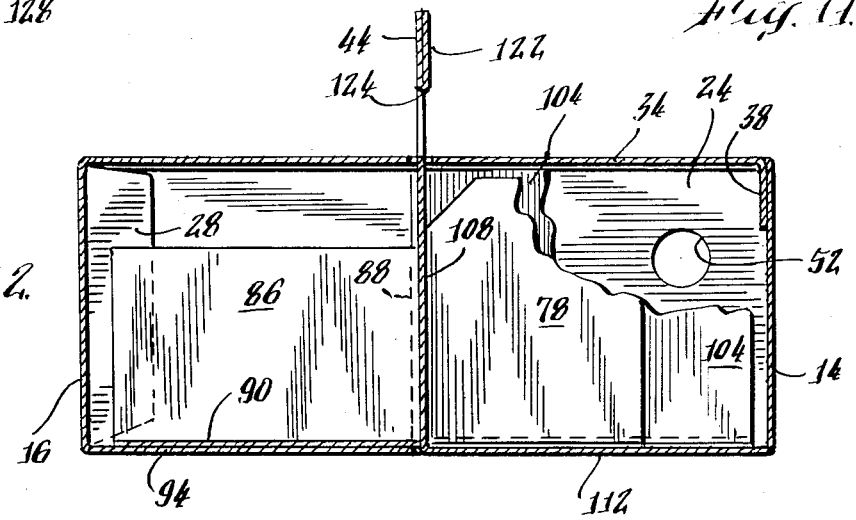
FIG. 12 is a cross sectional view taken substantially along the plane indicated by line 12—12 of FIG. 10.
Figure 13:
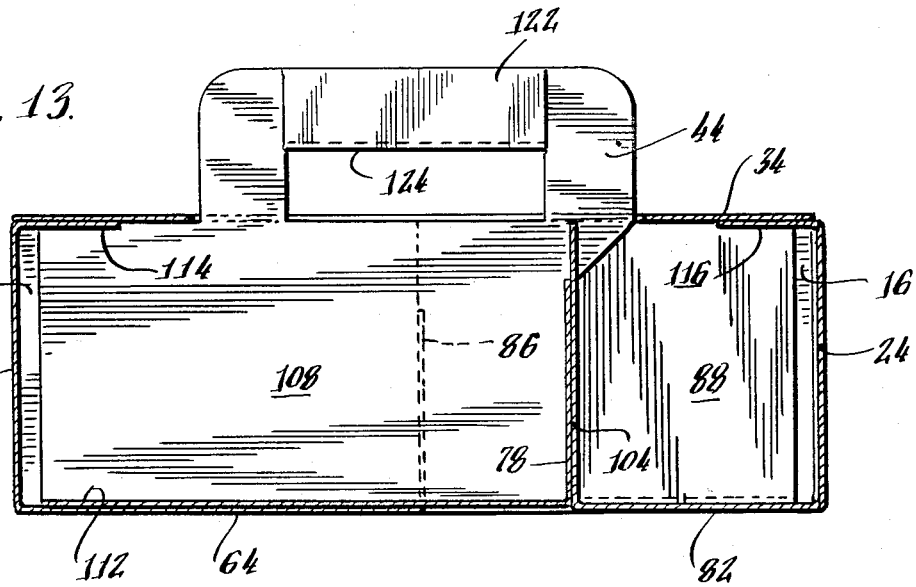
FIG. 13 is a cross sectional view taken substantially along the plane indicated by line 13—13 of FIG. 10.

To form corner 70, panel 24 is first folded along edge 26 until it is substantially perpendicular to panel 14. Panel 68 is then folded along edge 60 until it is substantially perpendicular to panel 24. Glue flap 72 of panel 62 is then folded along edge 76 until it is substantially parallel to the body of panel 62. Glue is applied to flap 72 at glue spot 74. Panel 62 is then folded along edge 54 until the panel is substantially perpendicular to front panel 14. During this folding, five sided flap 78 of panel 62 is folded along edge 80 so that flap 78 ends up above panel 68 as shown in FIGS. 2, 3 and 4. The glue on glue spot 74 fixedly attaches flap 72 to bottom wall panel 82. Flap 72 is hingedly connected to bottom wall panel 112 along edge 76.

Next, corner 84 (FIG. 5) between panels 16, 18 and the bottom of the carton is formed. In the process of forming this corner, panels 86 and 88 are oriented so as to serve as internal partitions in the finished carton 10. To form corner 94, glue flap 90 of panel 66 is first folded along edge 92 until the flap is substantially parallel with panel 94 (FIGS. 1–4). This movement of flap 90 causes flaps 86 and 88 to move relative to each other and relative to panel 94 so that when flap 90 is substantially parallel to panel 94, panels 86 and 88 are substantially perpendicular to panel 94 and substantially perpendicular to each other. The relative movement of panels 86 and 88 occur by means of the hinged connections along edges 92, 96, 98 and 100. To form corner 84, panel 64 is folded along edge 56 until it is substantially perpendicular to panel 18; panel 66 with flap 90 substantially parallel to panel 94 is folded along edge 58 until the panel is substantially perpendicular to panel 16; finally, panel 16 is folded relative to panel 18 along edge 22 until panel 16 and 18 are substantially perpendicular. During the folding of panels 16 and 18, bottom wall panel 64 passes over flap 90. Glue spot 102 is used to fixedly attach panel 64 to flap 90. As discussed above, flap 90 is hingedly connected to bottom wall panel 94 along edge 92.

After corners 70 and 84 are completed, internal divider panel 104 is folded along edge 106 until it is substantially perpendicular to bottom wall panel 82. Then, internal divider panel 78 is folded along edge 80 until it is substantially perpendicular to internal divider panel 108. Internal divider panel 108 is then folded along edge 110 until it is substantially perpendicular to bottom wall panel 112. As shown in FIG. 6, panel 78 passes to the right of panel 104 as panel 108 is folded about edge 110.

The body portion 11 of carton 10 is now ready to be completed. As shown in FIGS. 5, 6, 7 and 9, this is done by folding panels 14 and 18 along edge 20 until panel 16 meets panel 24 along free edge 32 of panel 24. Glue flap 28 is then tucked behind panel 24 and glued to that panel to complete formation of body portion 11 of carton 10. During the folding along edge 20, bottom wall panel 112 passes over a portion of bottom wall panel 64 and bottom wall panel 94 passes over a portion of bottom wall panel 82. Adjacent bottom wall panels 112 and 64 are unattached, as are adjacent bottom wall panels 82 and 84. This is to be compared with adjacent bottom wall panels 112 and 82 and with adjacent bottom wall panels 64 and 94 which, as described above, are hingedly connected by means of flaps 72 and 90, respectively. As described below, this allows the carton to be collapsed by inward pressure on corners 126, 128, or alternatively, edges 20, 30.

As shown in FIGS. 7 and 9, the completed body of carton 10 includes four compartments or cells of unequal sizes especially adapted to receive products of different sizes such as those sold at fast food establishments.

To close carton 10, cover element 34 is folded along edge 36 and flap 38 is tucked in behind front panel 14 by being folded along edge 40. During this process, carrying handle element 44 is inserted through aperture 42. Handle 44 includes flap 122 which when folded along edge 124 provides a space in the handle for the user's fingers. Also during closure, flaps 114 and 116 which extend from panels 18 and 24, respectively, are folded inward by means of edges 118 and 120, respectively.

An important feature of the carton of the present invention is its ability to be folded flat after having been glued together so as to provide a small package for shipping and storage. The folded or collapsed state is shown in FIG. 8. This configuration is achieved by pressing inward on corners 126, 128 or edges 20, 30 with cover element 34 in its open position. Upon pulling outward on those corners or edges, carton 10, including its internal compartments of unequal sizes, automatically reassumes the erect state shown in FIG. 9.

What is claimed is:

1. A paperboard carton having a plurality of internal cells of varying size, said carton comprising:

(a) a front wall panel;

(b) a rear wall panel;

(c) a pair of side wall panels;

(d) said front, rear and side wall panels being foldably connected together in series to form sides for said carton;

(e) a first bottom wall panel foldably connected to said front wall panel;

(f) a second bottom wall panel foldably connected to one of said side wall panels;

(g) a third bottom wall panel foldably connected to said rear wall panel;

(h) a fourth bottom wall panel foldably connected to the other of said side wall panels;

(i) a first divider panel foldably connected to one of said first and third bottom wall panels;

(j) a second divider panel foldably connected to said first divider panel, said second divider panel being foldably connected to a first triangular glue panel which is also foldably connected to said one of said first and third bottom wall panels, said first triangular glue panel providing a foldable connection between said first and second bottom wall panels;

(k) a third divider panel foldably connected to the other of said first and third bottom wall panels and disposed adjacent to said first divider panel, said third divider panel including an upwardly projecting handle portion;

(l) means forming a hand grip opening in said handle portion;

(m) a fourth divider panel foldably connected to said third divider panel along a fold line which is laterally offset from a vertical midline of said third divider panel and from said hand grip opening so that an imaginary extension of said fold line does not pass through said hand grip opening;

(n) a fifth divider panel foldably connected to said fourth bottom wall panel, said fifth divider panel lying adjacent to said fourth divider panel;

(o) a second triangular glue panel foldably connected to said other of said first and third bottom wall panels and free of connection with said third divider panel, said second triangular glue panel being operable to provide a foldable connection between said third and fourth bottom wall panels; and (p) said first divider panel and said third divider panel being operable to divide said carton interior into two substantially equal compartments between said front wall panel and said rear wall panel, said second divider panel being operable to divide one of said compartments into substantially equal cells, and said fourth and fifth divider panels being operable to divide the other of said compartments into substantially unequal cells.

2. The carton of claim 1 further comprising a cover panel foldably connected to one of said front and rear panels, said cover panel including a slot through which said handle portion projects when said cover panel is in a closed position.

* * * * *